US006164094A

United States Patent [19]

Lonati et al.

[11] Patent Number: 6,164,094

[45] Date of Patent: Dec. 26, 2000

[54] METHOD FOR MANUFACTURING A DRESSING ITEM WITH A CIRCULAR KNITTING MACHINE, AND ITEM OBTAINED WITH THE METHOD

[75] Inventors: Francesco Lonati; Ettore Lonati; Fausto Lonati; Tiberio Lonati, all of Brescia, Italy

[73] Assignee: Santoni S.p.A., Brescia, Italy

[21] Appl. No.: 09/215,187

[22] Filed: Dec. 18, 1998

[30] Foreign Application Priority Data

Dec. 23, 1997 [IT] Italy ..... MI97A2870

[51] Int. Cl.[7] ..... D04B 9/42

[52] U.S. Cl. ..... 66/172 R; 66/176

[58] Field of Search ..... 66/169 R, 170, 66/171, 189, 172 R, 172 E, 175, 176, 177, 178 R

[56] References Cited

U.S. PATENT DOCUMENTS

| | | | |
|---|---|---|---|
| Re. 26,667 | 9/1969 | Sarbo | 66/171 |
| 1,197,244 | 9/1916 | Velasko | 66/175 |
| 1,868,854 | 7/1932 | Smarr | 66/175 |
| 2,519,534 | 8/1950 | Artzt | 66/175 |
| 2,881,603 | 4/1959 | Vendetti | 66/172 R |
| 4,624,115 | 11/1986 | Safrit et al. . | |

FOREIGN PATENT DOCUMENTS

| | | |
|---|---|---|
| 0 387 763 | 9/1990 | European Pat. Off. . |
| 0 387 765 | 9/1990 | European Pat. Off. . |
| 97 47794 | 12/1997 | WIPO . |

*Primary Examiner*—Danny Worrell
*Attorney, Agent, or Firm*—Guido Modiano; Albert Josif; Daniel O'Byrne

[57] ABSTRACT

A method for manufacturing a dressing item such as an undershirt, body suit or the like with a circular knitting machine, and an item obtained thereby, the method comprising: at least one first step, during which an annular border is formed which constitutes the neck of the item; at least one second step, during which a first tubular portion of knitting is formed starting from the annular border; at least one third step, during which a second tubular portion of knitting is formed to continue the first tubular portion of knitting; and a fourth step, during which a completion portion of the item is formed. The annular border is formed by at least one prestretched elastic yarn and/or by using a limited number of needles with respect to the number used to form the first tubular portion of knitting and/or the second tubular portion of knitting, so as to obtain an item with a neck having a smaller diameter than the remaining part of the item and without seams in the shoulder region.

33 Claims, 2 Drawing Sheets

METHOD FOR MANUFACTURING A DRESSING ITEM WITH A CIRCULAR KNITTING MACHINE, AND ITEM OBTAINED WITH THE METHOD

BACKGROUND OF THE INVENTION

The present invention relates to a method for manufacturing a dressing item such as an undershirt, body suit or the like with a circular knitting machine, and to an item obtained with the method.

It is known that undershirts, some body suits or similar items of clothing are generally manufactured by cutting the front portion and the rear portion of the item from large pieces of knitted fabric and by subsequently stitching along the sides and shoulders of the item, or by starting from a substantially tubular item produced with circular knitting machines.

This basic item can have a perfectly tubular shape, i.e., with a diameter which is substantially constant along its extension. In this case, the item is then subjected to cutting operations in order to form the neck-hole and the openings for the passage of the user's arms and to stitching operations to join the front side to the rear side at the shoulders, to optionally apply the sleeves and to apply borders at the neck and optionally at the arm-holes.

In some cases, the basic item has a contoured shape, with a neck-hole at the neck region and two pairs of flaps of fabric which are meant to be stitched in pairs to form the shoulders of the undershirt.

In any case, undershirts or body suits obtained with conventional methods starting from an item manufactured with circular knitting machines have, in the shoulder region, a seam which joins the front part of the undershirt to the rear part and runs from the neck region to the lateral arm-holes or to the sleeves.

This seam, besides having an aesthetically unpleasant effect, can be uncomfortable for the user.

SUMMARY OF THE INVENTION

The aim of the present invention is to solve the above-described problem by providing a method which allows to produce, with a circular knitting machine, a dressing item for manufacturing undershirts, body suits or the like without a seam in the shoulder region.

Within the scope of this aim, an object of the invention is to provide a method which can be performed on a wide range of currently commercially available circular knitting machines.

Another object of the invention is to provide a method which allows to obtain a semifinished component which requires finishing operations which can be performed with low costs.

This aim, these objects and others which will become apparent hereinafter are achieved by a method for manufacturing a dressing item such as an undershirt, body suit or the like with a circular knitting machine, characterized in that it comprises: at least one first step, during which an annular border is formed which constitutes the neck of the item; at least one second step, during which a first tubular portion of knitting having a gradually increasing diameter is formed starting from said annular border; at least one third step, during which a second tubular portion of knitting is formed to continue said first tubular portion of knitting; and a fourth step, during which a completion portion of the item is formed.

The item obtained with the method according to the invention is characterized in that it comprises a knitted tubular body which has, starting from one of its longitudinal ends: an annular border; a first tubular portion of knitting, which has no longitudinal seams and has a diameter which increases starting from said annular border; a second tubular portion of knitting; and a completion portion of the item.

BRIEF DESCRIPTION OF THE DRAWINGS

Further characteristics and advantages of the present invention will become apparent from the following detailed description of two preferred but not exclusive embodiments of the method according to the invention, illustrated only by way of non-limitative example in the accompanying drawings, wherein.

DESCRIPTION OF THE PREFERRED EMBODIMENTS

Figure 1:
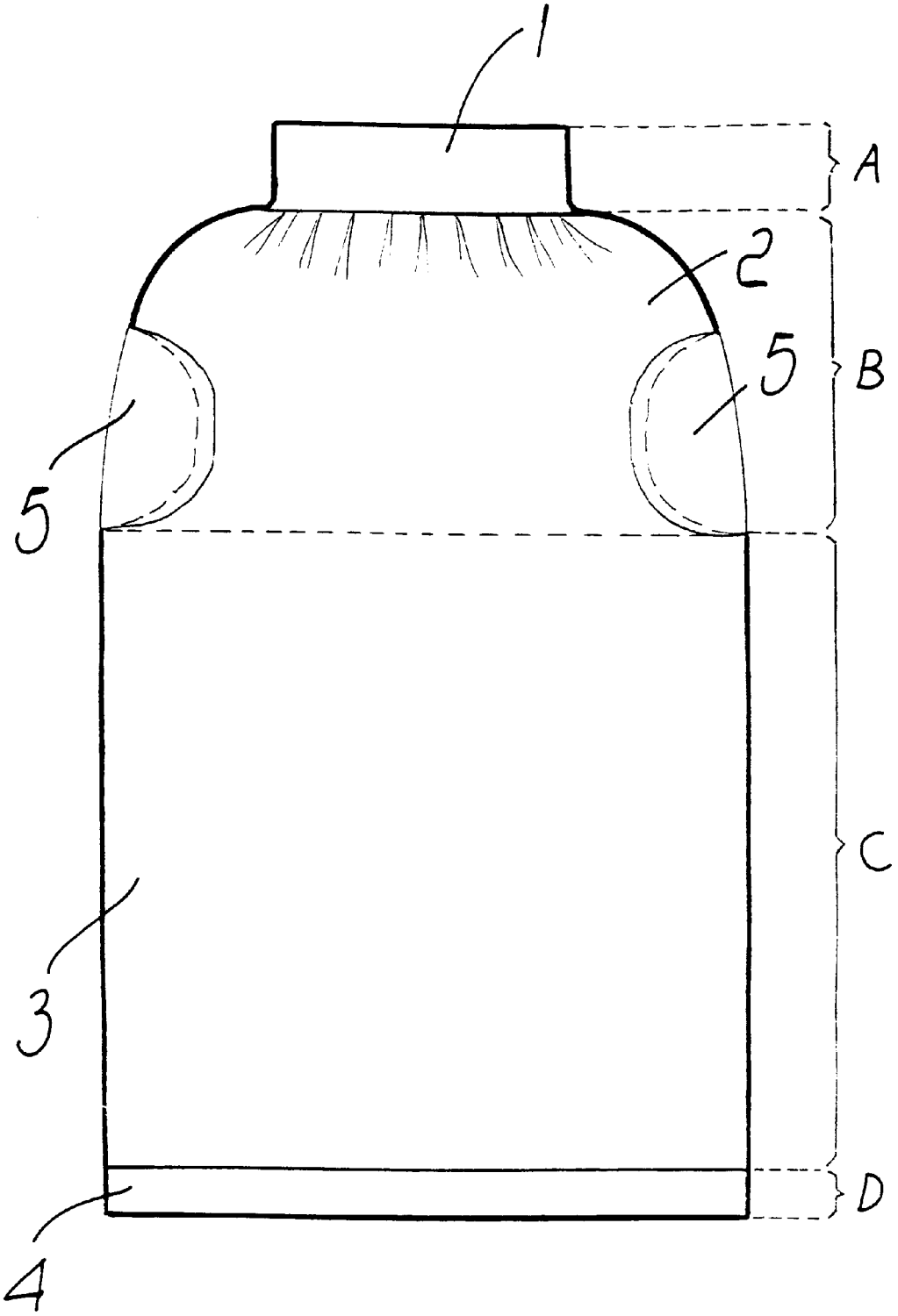
FIG. 1 is a schematic view of an item obtained with the method according to the invention in a first embodiment.

With reference to FIG. 1, the method according to the invention, in a first embodiment, comprises: at least one first step A, during which an annular border 1 is formed which constitutes the neck of the item; at least one second step B, during which a first tubular portion of knitting 2 is formed starting from the annular border 1; at least one third step C, during which a second tubular portion of knitting 3 is formed to continue the first tubular portion of knitting 2; and a fourth step D, during which a completion portion 4 of the item is formed.

Preferably, the first tubular portion of knitting 2 has a diameter which gradually increases starting from the annular border 1. This can be achieved by forming the annular border 1, during the first step A, by knitting, at one or more feeds or drops of the machine, with only some of the needles of the machine, for example one needle in every two contiguous needles, or one needle in three, or one needle in four, or one needle in five, or one needle in six, in seven, eight, nine, ten etcetera. As an alternative, it is possible to knit, at one or more feeds of the machine, with two contiguous needles in every four or in every six and so forth, so as to obtain a border 1 which has a significantly smaller diameter than the tubular portion 3 knitted in the third step C.

During the second step B, the needles that knit at the various feeds of the machine are gradually increased so as to obtain a tubular portion 2 whose diameter increases gradually starting from the annular border 1.

As an alternative, the annular border 1 can have the same diameter, during knitting, as the first tubular portion of knitting 2 and optionally as the second tubular portion of knitting 3, in that it can be knitted with the same number of needles used to knit the tubular portions of knitting 2 and 3. In this case, the annular border 1 is formed by using at least one prestretched elastic yarn so that the item, at the end of the process, still has an annular border 1 constituting the neck, which has a smaller diameter than the tubular portions 2 and 3 owing to the elastic reaction of the yarn or yarns used.

Even if the annular border 1 is formed with a reduced number of needles, it can still be formed by using at least one prestretched elastic yarn, so as to increase the reduction in the diameter of the item at the annular border 1 with respect to the remaining part of the item and allow it to widen when the item is to be put on.

The border 1 can be formed with single-thickness knitting or with double-thickness knitting, for example by using the needles of the cylinder and the hooks of the dial of the machine, in a manner which is similar to the knitting of the double-thickness top of socks, or by using only the needles of the cylinder with drop-stitch knitting of a per se known type. With these kinds of knitting, the initial row of knitting of the border 1 is retained by the hooks of the dial of the machine or by some of the needles used to form the border 1, while other needles continue to form the knitting at the subsequent feeds of the machine. The initial row is then knitted in with the first row of the tubular portion 2 at the beginning of the second step B.

At least one elastic yarn, or at least one elastic yarn and one or more nonelastic yarns knitted together, are used to form the tubular portion 2 as well.

During the execution of the second step B, portions of knitting 5 are formed, at two diametrically opposite regions of the tubular portion 2, which are visually different from the remaining part of the knitting of the tubular portion 2 and are meant to be subsequently removed to obtain two openings for the passage of the arms of the wearer or for applying the sleeves.

The visual differentiation, which is used in the subsequent step for cutting and for optionally applying the sleeves, can be obtained for example by knitting the portions 5 by means of two sets of needles arranged in two substantially diametrically opposite positions of the needle cylinder, with a single yarn, while the remaining part of the first tubular portion 2 is formed by using two or more yarns, optionally with pattern effects for aesthetic reasons.

The yarn used to form the portions 5 can be a cheaper yarn, since the portions 5 are meant to be removed.

As an alternative, the first tubular portion of knitting 2 can be formed by using a single yarn both for the portions 5 and for the remaining part of the first tubular portion 2, and the portions 5 can be delimited by stitches of a different kind, for example tuck stitches, or of a different color with respect to the adjacent stitches.

Another alternative, instead of knitting the portions 5, is to cut and clamp the yarns, at the beginning of these portions, directly on the machine during the forming of the various rows, so as to obtain directly on the machine the openings for the passage of the arms or for applying the sleeves.

In this type of knitting, the takeup of the yarn or yarns used to form the tubular portion 2, at the rows of knitting that affect the portions 5, is interrupted for a preset number of needles which can vary row by row so as to achieve the intended shape for the openings at the portions 5.

The third step C forms the tubular portion 3, which preferably has a substantially constant diameter along its extension although, if a particular shape of the item is required, it is possible to knit said tubular portion 3 with a variable diameter.

According to the requirements, the number of stitches per row of knitting used to form said tubular portion 3 is preferably between two and ten times the number of stitches that compose each row of the border 1.

The second tubular portion 3 can be formed by using, for each stitch, a single yarn or two or more elastic and nonelastic yarns, optionally forming patterns which can be obtained in a per se known manner.

In the fourth step D it is possible to simply form a limited number of completion rows or a double-thickness border, formed in a manner similar to the one described with reference to the annular border 1.

Figure 2:
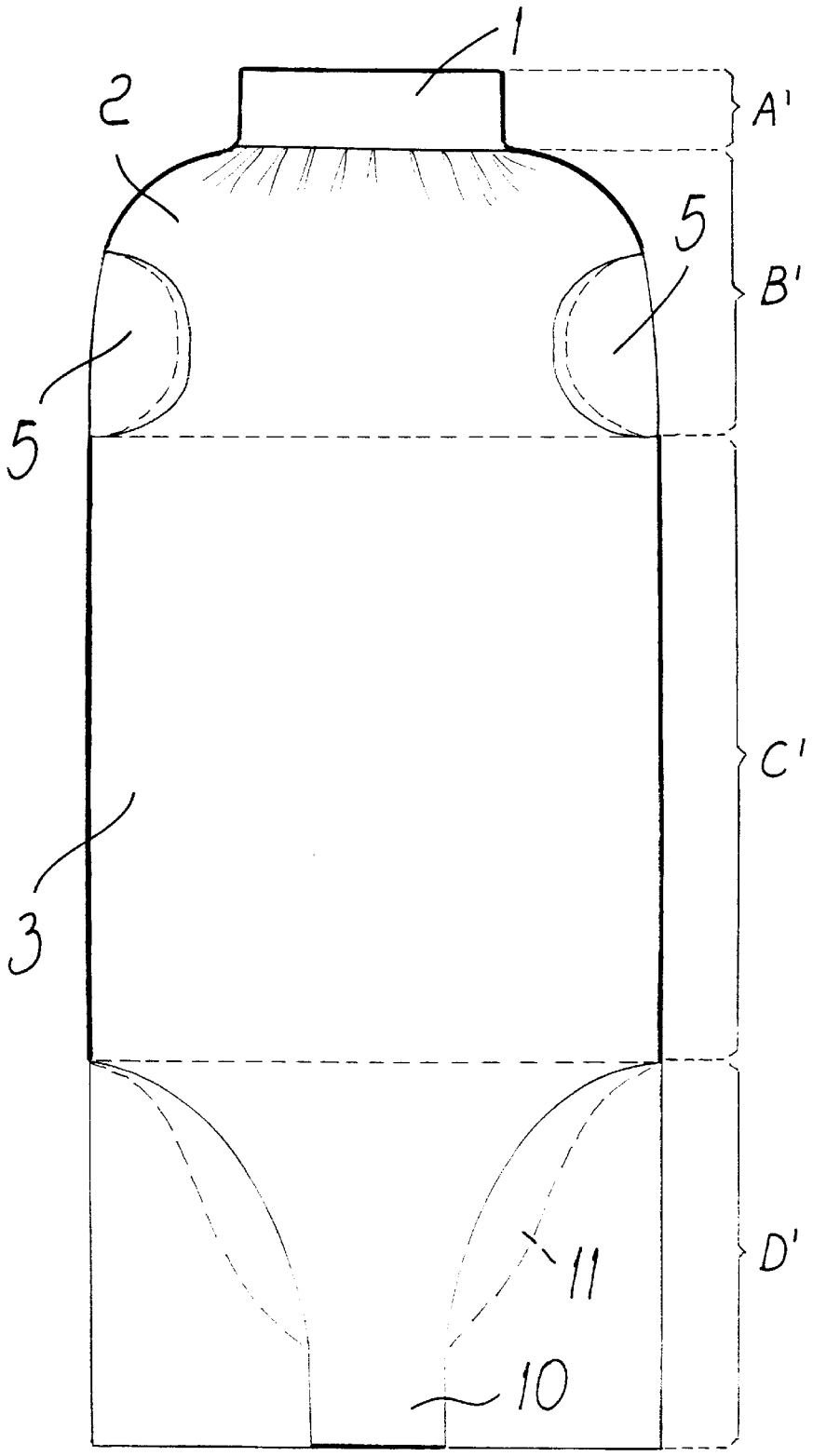
FIG. 2 is a schematic view of an item obtained with the method according to the invention in a second embodiment.

With reference to FIG. 2, the method according to the invention, in a second embodiment, comprises: a first step A', during which an annular border 1 is formed; a second step B', during which a first tubular portion 2 with an increasing diameter is formed; and a third step C', during which a second tubular portion 3 is formed which has a preferably substantially constant diameter, as described with reference to steps A, B and C of the first embodiment.

In a fourth step D', instead of simply forming a completion border, two portions 10 and 11 are knitted in two diametrically mutually opposite regions, extending the second tubular portion 3 on the front side and on the rear side of the item.

The two portions 10 and 11 are meant to be mutually stitched proximate to their lower end to form the crotch region of an item such as a body suit.

The portions 10 and 11 can be formed by using two sets of needles of the needle cylinder of the machine which are located in two substantially diametrically mutually opposite regions and by varying the number of active needles row by row, so as to obtain the intended shape of the borders of the portions 10 and 11 that constitute the leg openings of the body suit. The yarn or yarns used to form the portions 10 and 11 are cut and clamped at the end of the set of active needles and are then fed again to the subsequent set of active needles.

As an alternative, the fourth step D' can be performed by activating the needles of the machine that are meant to form the portions at the leg openings, but excluding said needles from knitting at some feeds of the machine so as to obtain, in the regions that correspond to the leg openings, a smaller number of rows than the rows of the portions 10 and 11, thus obtaining, directly in the machine, part of the leg openings, which can be completed by removing the row portions knitted with a reduced number of feeds.

As an alternative, the portions related to the leg openings can be knitted with a single yarn, while the portions 10 and 11 are knitted with at least two yarns, or the portions that correspond to the leg openings and are meant to be removed can be simply knitted with a pattern effect or other stitches so as to visually differentiate them from the portions 10 and 11 to facilitate the subsequent removal operation.

Another alternative is knitting all of the additional tubular portion to continue the second tubular portion with a single yarn, delimiting the portions that are meant to be removed to form the leg openings by means of stitches of a different type, for example tuck stitches, or of a different color with respect to the adjacent stitches.

The item obtained with the method according to the invention substantially has, starting from one of its longitudinal ends: an annular border 1, which has a reduced diameter; a first tubular portion of knitting 2, which has no longitudinal seams and whose diameter increases starting from the annular border 1, a second tubular portion of knitting 3, which has a substantially constant diameter; and a completion portion of the item which, depending on the type of the item to be formed, can be simply constituted by a border, by a double-thickness border 4, or by two portions 10 and 11 which are meant to be stitched together to form the crotch region of a body suit.

The item thus produced can be subjected to finishing treatments by stitching borders at the openings for the arms of the user or by applying sleeves and by applying borders along the sides of the portions 10 and 11, if provided.

In practice it has been observed that the method according to the invention fully achieves the intended aim, since it allows to obtain an item such as an undershirt, body suit or the like without seams in the shoulder region.

The method thus conceived is susceptible of numerous modifications and variations, all of which are within the scope of the inventive concept; all the details may also be replaced with other technically equivalent elements.

In practice, the materials employed, as well as the dimensions, may be any according to requirements and to the state of the art.

The disclosures in Italian Patent Application No. MI97A02870 from which this application claims priority are incorporated herein by reference.

What is claimed is:

1. A method for manufacturing a dressing item with a circular knitting machine, comprising:

at least one first step, during which an annular border is formed which constitutes a neck part of the item;

at least one second step, during which a first tubular portion of knitting having a gradually increasing diameter with respect to said annular border is formed starting from said annular border;

at least one third step, during which a second tubular portion of knitting is formed to continue said first tubular portion of knitting;

and a fourth step, during which a completion portion of the item is formed;

said annular border being formed of a plurality of rows of stitches each formed by using a smaller number of needles of the machine than a number used to form remaining parts of the item including said first tubular portion so that the number of stitches of the rows of said annular border are less than the number of stitches of the rows of said first tubular portion.

2. The method of claim 1, wherein said annular border is formed by using at least one prestretched elastic yarn.

3. A method for manufacturing a dressing item with a circular knitting machine having a needle cylinder, comprising:

at least one first step, during which an annular border is formed which constitutes a neck part of the item by using at least one prestretched elastic yarn;

at least one second step, during which a first tubular portion of knitting is formed starting from said annular border;

at least one third step, during which a second tubular portion of knitting is formed to continue said first tubular portion of knitting;

and a fourth step, during which a completion portion of the item is formed;

said annular border being formed of a plurality of rows of stitches each formed by using a smaller number of needles of the machine than a number used to form remaining parts of the item including said first tubular portion so that said first tubular portion having an increased diameter than that of said annular border and so that the number of stitches of the rows of said annular border are less than the number of stitches of the rows of said first tubular portion.

4. The method of claim 3, wherein during said first step said annular border is formed with double-thickness knitting be retaining an initial row of knitting of said annular border by some of the needles used to form said annular border while other needles continue to form rows of knitting of said border at subseguent feeds of the circular knitting machine.

5. The method of claim 3, wherein said first tubular portion of knitting, during said second step, is formed by gradually increasing a number of active needles of the machine with respect to a number of needles used to form said annular border during the first step.

6. The method of claim 3, wherein a ratio between a number of stitches per row of said annular border, formed during said first step, and a number of stitches per row of said second tubular portion of knitting, formed during said third step, is substantially between 1:10 and 1:2.

7. The method of claim 3, wherein during said first step said annular border is formed with double-thickness knitting.

8. The method of claim 3, wherein during said second step two portions are formed at said first tubular knitting portion, which are located in two diametrically mutually opposite regions and are visually different from remaining parts of said first tubular portion of knitting, said two portions being removable in order to form in the item two arm passages, sleeves being further applyable to said passages.

9. The method of claim 8, wherein said two portions are knitted with a single yarn, while adjacent parts of the first tubular portion are knitted with at least two yarns.

10. The method of claim 8, wherein said two portions are formed so as to be delimited with respect to adjacent stitches by stitches being any of a different type and different color.

11. The method of claim 3, wherein during said second step knitting is interrupted, and in two diametrically mutually opposite regions of the first tubular portion of knitting being formed, by cutting and clamping yarns and by deactivating two sets of needles located in two diametrically opposite regions of the needle cylinder, so as to form, at said regions, two arm openings, sleeves being further applyable to said openings.

12. The method of claim 11, wherein said fourth step comprises forming of a completion border.

13. The method of claim 12, wherein said completion border is formed with a double thickness.

14. The method of claim 3, wherein said fourth step comprises forming, in two diametrically mutually opposite regions, two diametrically mutually opposite portions to continue said second tubular portion of knitting formed during said third step.

15. The method of claim 3, wherein said fourth step comprises forming of an additional tubular portion of knitting to continue said second tubular portion of knitting formed during said third step; said additional tubular portion of knitting having, in two diametrically mutually opposite regions thereof, portions which are visually different from remaining parts of said additional tubular portion of knitting, said visually different portions being removable for obtaining two lateral leg openings proximate to a completion end of the item.

16. The method of claim 15, wherein said visually different portions, formed during said fourth step, are knitted with a smaller number of yarns than remaining parts of the additional tubular portion of knitting formed during said fourth step.

17. The method of claim 16, wherein during said fourth step said two visually different portions are delimited by stitches being any of a different type and color with respect to adjacent stitches.

18. The method of claim 3, wherein said fourth step comprises formation of an additional tubular portion of knitting to continue the tubular portion of knitting formed during said third step; two mutually diametrically opposite regions of the item being formed by using a smaller number of feeds than a number used to form a remaining part of the additional tubular portion of knitting formed during said fourth step in order to form two lateral leg openings proximate to a completion end of the item.

19. The method of claim 3, wherein said fourth step comprises formation of an additional tubular portion of knitting to continue said second tubular portion of knitting formed with yarns during said third step, interrupting the knitting by cutting and clamping the yarns, deactivating two sets of needles arranged in two diametrically opposite regions of the needle cylinder, in order to form two lateral leg openings proximate to a completion end of the item.

20. A dressing item, manufactured with a circular knitting machine having a needle cylinder, having a tubular knitted body comprising, starting from one of its longitudinal ends: an annular border; a first tubular portion of knitting without longitudinal seams, said first tubular portion having a diameter which increases starting from said annular border; a second tubular portion of knitting; and a completion portion; said annular border being formed of a plurality of rows of stitches, and the number of stitches of the rows of said annular border being less than the number of stitches of the rows of said first tubular portion.

21. The item of claim 20, wherein said second tubular portion of knitting has a substantially constant diameter.

22. The item of claim 20, formed by rows of stitches with a ratio between a number of stitches per row of said annular border and a number of stitches per row of said second tubular portion of knitting of substantially between 1:10 and 1:2.

23. The item of claim 20, wherein said annular border is composed of at least one elastic yarn.

24. The item of claim 20, wherein said annular border is of the double-thickness type.

25. The item of claim 20, wherein said first tubular portion of knitting has, at two diametrically mutually opposite regions thereof, arm openings, and sleeves being further applyable to said openings.

26. The item of claim 20, wherein said first tubular portion of knitting has, in two diametrically mutually opposite regions thereof, parts which are visually different from remaining parts of said first tubular portion of knitting, said visually different parts being removable in order to form in the item two arm passages, sleeves being further applyable to said passages.

27. The item of claim 26, wherein said visually different parts of said first tubular portion of knitting are delimited by stitches being any of a different type and color with respect to adjacent stitches.

28. The item of claim 20, wherein said first tubular portion of knitting has, in two mutually diametrically opposite regions thereof, portions which are formed with a single yarn, while adjacent parts of said first tubular portion are knitted with stitches formed by at least two yarns.

29. The item of claim 20, wherein said completion portion of the item is constituted by a double-thickness border.

30. The item of claim 29, wherein said completion portion of the item comprises two portions which extend, in two mutually diametrically opposite regions, from said second tubular portion of knitting.

31. The item of claim 20, wherein said completion portion of the item comprises an additional tubular portion of knitting to continue said tubular portion of knitting, said additional tubular portion having in two mutually diametrically opposite regions, parts which are visually different from remaining parts thereof, said two visually different parts being removable to obtain two lateral leg openings proximate to a completion end of the item.

32. The item of claim 31, wherein said visually different parts are knitted with a single yarn, while adjacent parts are knitted with stitches composed of at least two yarns.

33. The item of claim 31, wherein said visually different parts of said additional tubular portion of knitting are delimited by stitches being any of a different type and color with respect to adjacent stitches.

* * * * *